US008419664B2

(12) United States Patent
Knyrim

(10) Patent No.: US 8,419,664 B2
(45) Date of Patent: Apr. 16, 2013

(54) MASSAGING DEVICE

(76) Inventor: Jörg Knyrim, Karlsruhe (DE)

( * ) Notice: Subject to any disclaimer, the term of this patent is extended or adjusted under 35 U.S.C. 154(b) by 591 days.

(21) Appl. No.: 12/591,573

(22) Filed: Nov. 24, 2009

(65) Prior Publication Data

US 2010/0130897 A1 May 27, 2010

(30) Foreign Application Priority Data

Nov. 27, 2008 (DE) ..... 20 2008 015 778 U

(51) Int. Cl.
*A61H 7/00* (2006.01)
*A61H 19/00* (2006.01)
*A61H 21/00* (2006.01)

(52) U.S. Cl.
USPC ..... 601/89; 601/46; 601/53; 600/38

(58) Field of Classification Search ..... 600/38; 601/46, 61, 63, 82, 80, 85, 87, 97, 101–103, 601/112–114, 118–120, 122–123, 125, 126, 601/129, 130, 137
See application file for complete search history.

(56) References Cited

U.S. PATENT DOCUMENTS

| | | | | |
|---|---|---|---|---|
| 7,828,717 | B2 * | 11/2010 | Lee | 600/38 |
| 2007/0179336 | A1 * | 8/2007 | Knyrim | 600/38 |
| 2010/0041944 | A1 * | 2/2010 | Levy | 600/38 |

FOREIGN PATENT DOCUMENTS

| | | |
|---|---|---|
| DE | 202007012531 | 12/2007 |
| EP | 1720503 | 6/2007 |
| EP | 2047833 | 4/2009 |

* cited by examiner

*Primary Examiner* — Patricia Bianco
*Assistant Examiner* — Kari Petrik
(74) *Attorney, Agent, or Firm* — Welsh Flaxman & Gitler LLC

(57) ABSTRACT

The invention relates to a massaging device in the shape of a rod having an essentially cylindrical end element, a shell forming the outer surface of the end element made of a rubber-elastic material and a drive unit for generating a motion on the end element, the drive unit forming a plurality of bearing and support surfaces, against which the shell bears and the bearing and support surfaces being designed for an oscillating deformation of the shell relative to the longitudinal axis (LA) of the end element radially outward and inward by means of radial stroke motions of the bearing and support surfaces. The massaging device features a first and second operating mode (T, W), in the first operating mode (T) the oscillating deformation along the longitudinal axis (LA) being in phase and in the second operating mode (W) out of phase.

17 Claims, 9 Drawing Sheets

T

W

B - B

A - A

MASSAGING DEVICE

BACKGROUND OF THE INVENTION

The invention relates to a massaging device in the shape of a rod with a cylindrical end element, a shell forming the outer surface of the end element made of a rubber-elastic material and a drive unit for generating a motion on the end element.

Such insertable massaging devices are known in the art. For example, EP 1 720 503 B1 discloses a massaging device in the form of a rod, which is made up of a drive unit with a plurality of jaw-like bearing surfaces, which bear from inside on a wall that at least partially forms the outer surface of the massaging device. The drive unit is designed so that an oscillating deformation of the wall occurs along the longitudinal axis and/or in the circumferential direction of the massaging device.

Based on the state of the existing art as described above, it is an object of the invention to present a massaging device that can be manufactured easily and cost-effectively and that enables a differentiated massaging effect.

SUMMARY OF THE INVENTION

An essential aspect of the massaging device according to the invention is the fact that the massaging device comprises a first and second operating mode, the oscillating deformation of the casing relative to the longitudinal axis of the end element taking place radially outward and inward by means of radial stroke motions of the bearing and support surfaces is in phase in the first operating mode and out of phase in the second operating mode. The first and second operating mode is determined by the drive direction of the drive unit. In particular, the operating mode can be selected by switching the direction of rotation of the shaft driving the drive unit, namely in the first operating mode a wave-like massage motion ("waver") and in the second operating mode a circumferential pulsing massaging motion ("throbber") is created. The massaging device according to the invention therefore enables differentiated massage functions, which can be implemented cost-effectively by simple technical means.

Especially advantageous is the fact that the first and second operating mode is determined by the drive direction of the drive unit and/or the bearing and support surfaces are formed by a plurality of support elements, preferably jaw elements.

In a further advantageous embodiment, several support elements arranged respectively in a common plane perpendicular to the longitudinal axis of the end element form a group of support elements and a plurality of such groups of support elements are provided consecutively along the longitudinal axis of the end element.

For the oscillating motion of the support elements, at least one shaft that can be driven by a drive is provided, on which several eccentric elements interact with the support elements. Advantageously, means are provided for driving the shaft in two directions of rotation, the respective direction of rotation of the shaft determining the operating mode of the massaging device.

Likewise advantageously, for guiding on the shaft, one eccentric element respectively comprises an inner opening and/or the at least one shaft comprises at least one shaft section with a polygonal or polygon-shaped cross section, preferably a rectangular cross section. The at least one shaft section forms at least two stop faces, and periodically recurring groups of several eccentric elements can be lined up at least along the shaft section of the shaft.

The inner openings of the eccentric elements of one group preferably have different cross sectional forms, the latter forming at least two stop faces, which interact with at least one stop face of the shaft depending on the direction of rotation of the shaft.

At least one eccentric element of the group is guided on the shaft section in a torsion-proof manner on the shaft longitudinal axis, the further eccentric elements of a group being guided rotatably on the shaft longitudinal axis by respectively different angular amounts limited by the interacting stop faces. The interacting stop faces can define angle ranges, whereby the angle ranges of all eccentric elements of one group can at least partially overlap.

Advantageously one eccentric element respectively comprises two opposing faces with a polygonal or polygon-shaped outer cross sectional form respectively, whereby the two opposing faces extend parallel to one another and are preferably twisted in relation to each other.

The eccentric elements have the same outer contour, preferably an at least partially twisted outer contour. In the first operating mode the outer contour formed by the totality of the eccentric elements is advantageously prismatic or essentially prismatic in shape and in the second operating mode approximately spiral-shaped, whereby in the second operating mode the two faces of the eccentric elements are lined up approximately congruently on the shaft along the longitudinal axis.

BRIEF DESCRIPTION OF THE DRAWINGS

Further embodiments, advantages and possible applications of the invention ensue from the following description of exemplary embodiments and the drawings. The invention is described in more detail below based on several exemplary embodiments with reference to the drawings, in which.

DETAILED DESCRIPTION OF THE INVENTION

Figure 1:
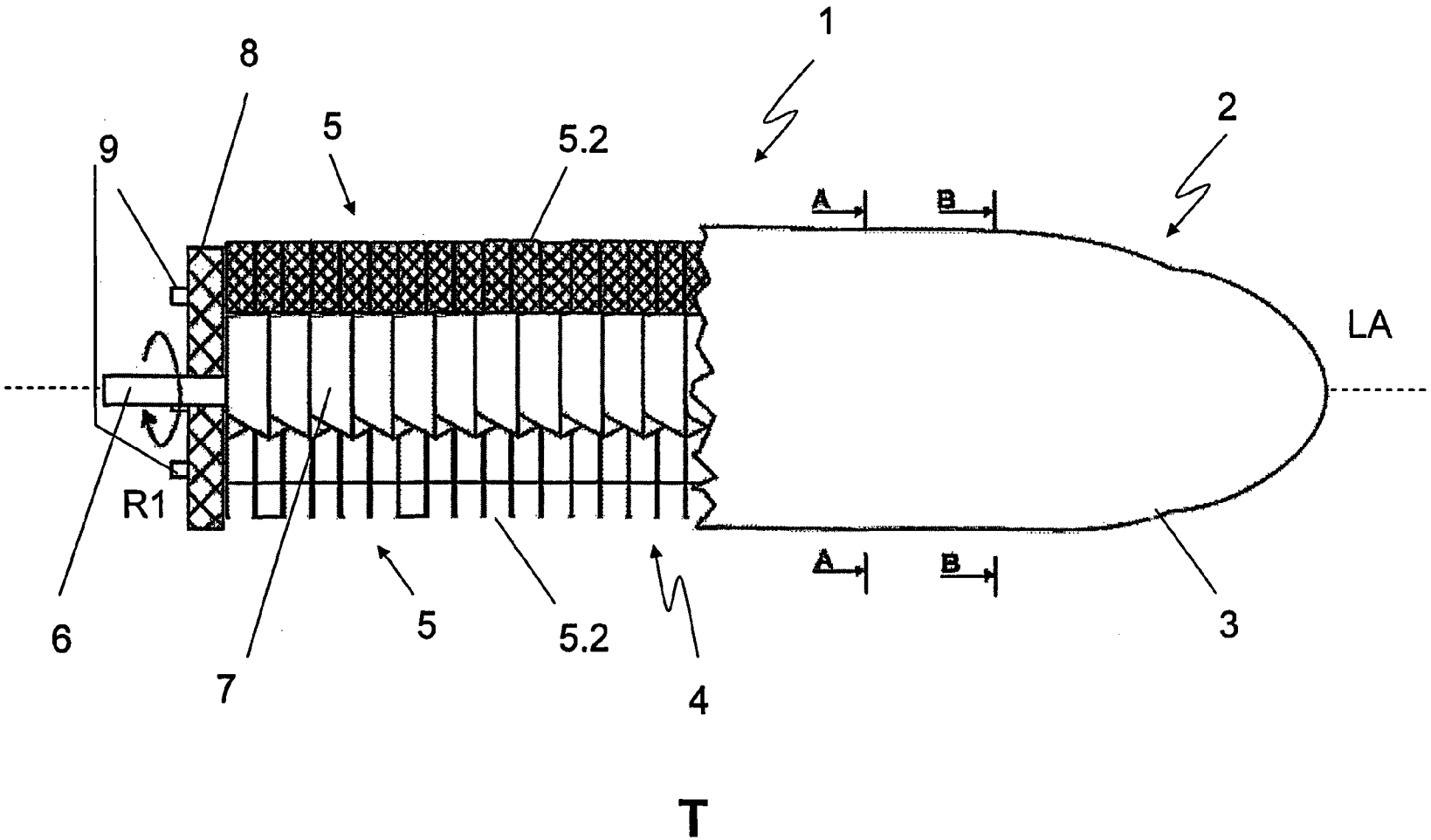
FIG. 1 shows a side view of the massaging device according to the invention with sectionwise longitudinal sections according to a first operating mode.
Figure 2:
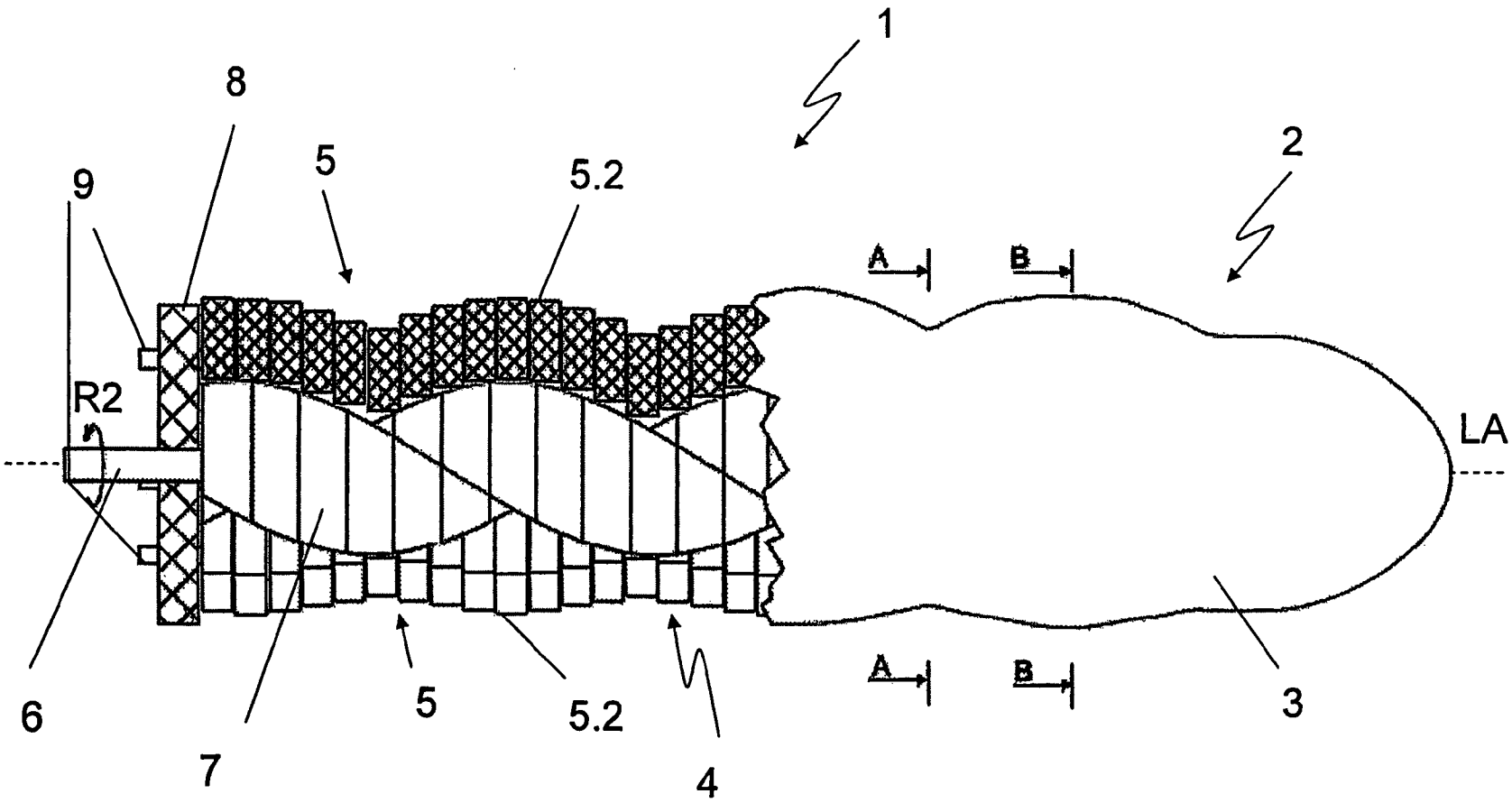
FIG. 2 shows a side view of the massaging device according to the invention with sectionwise longitudinal sections according to a second operating mode.
Figure 3B:
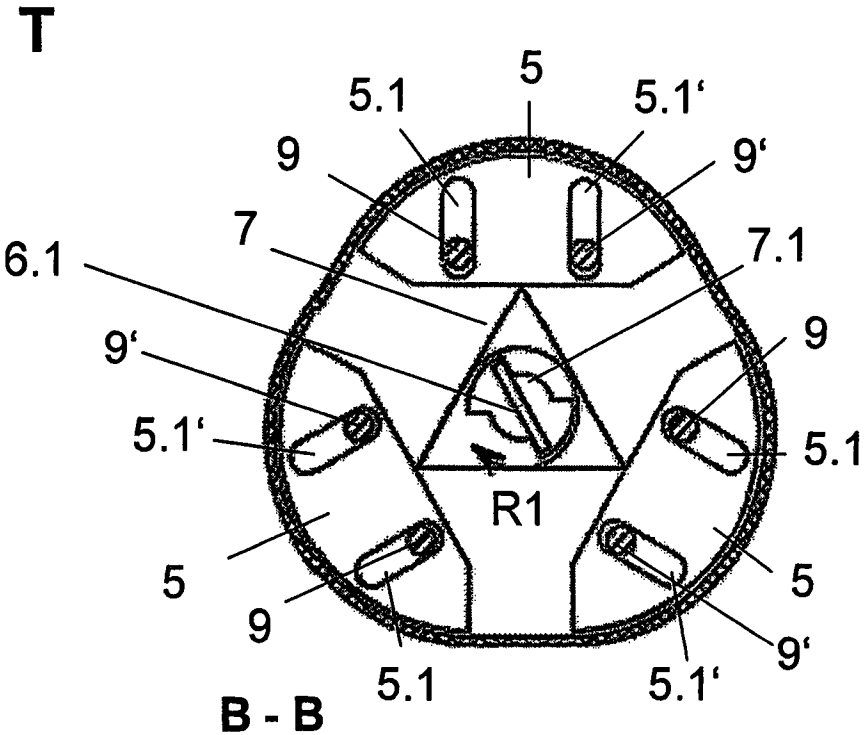
FIGS. 3*a, b* shows cross sections along the lines A-A and B-B through the massaging device according to the invention according to FIG. 1.
Figure 3A:
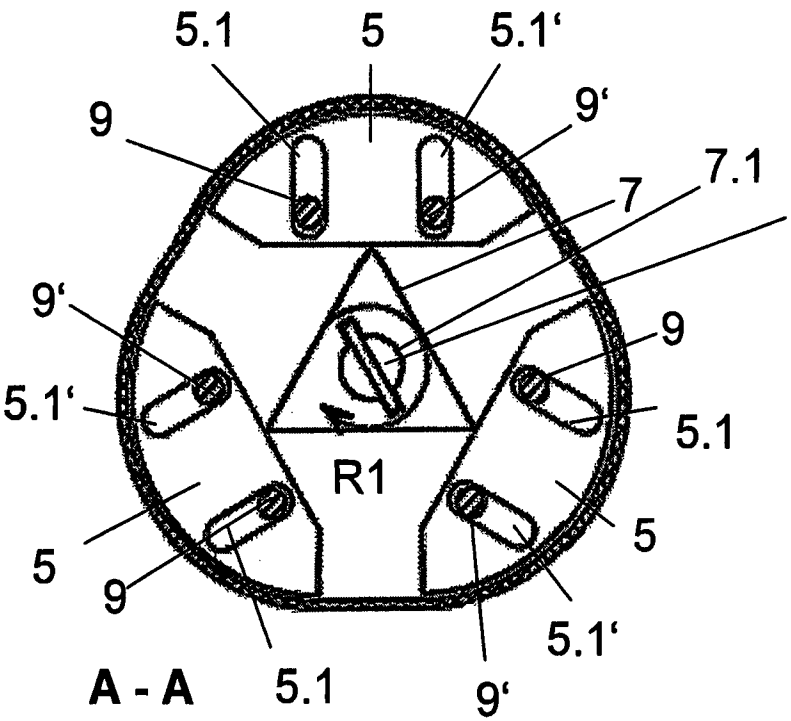
Figure 4B:
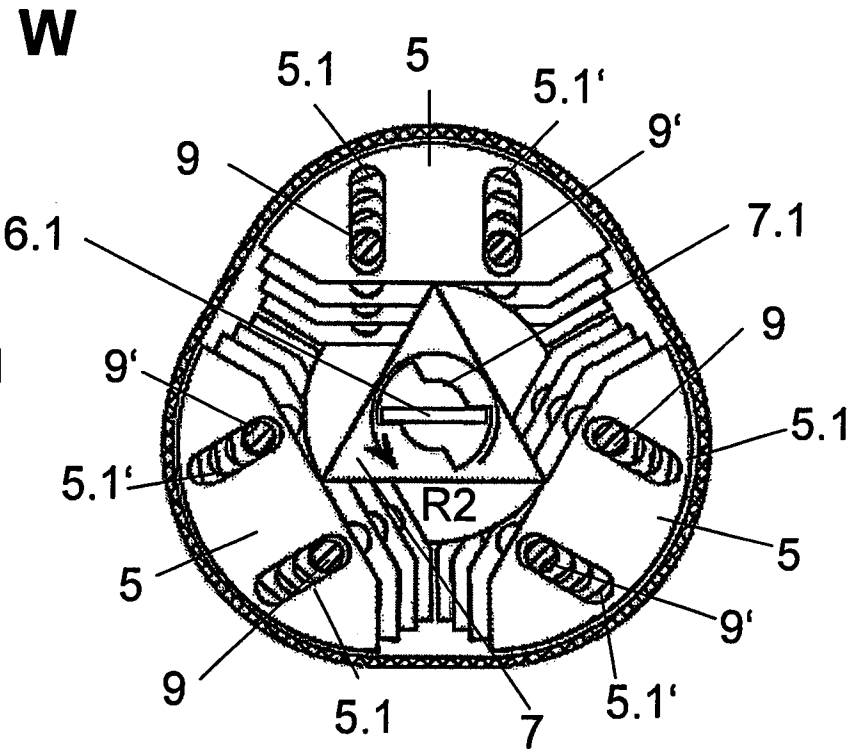
FIGS. 4*a, b* shows cross sections along the lines A-A and B-B through the massaging device according to the invention according to FIG. 2.
Figure 4A:
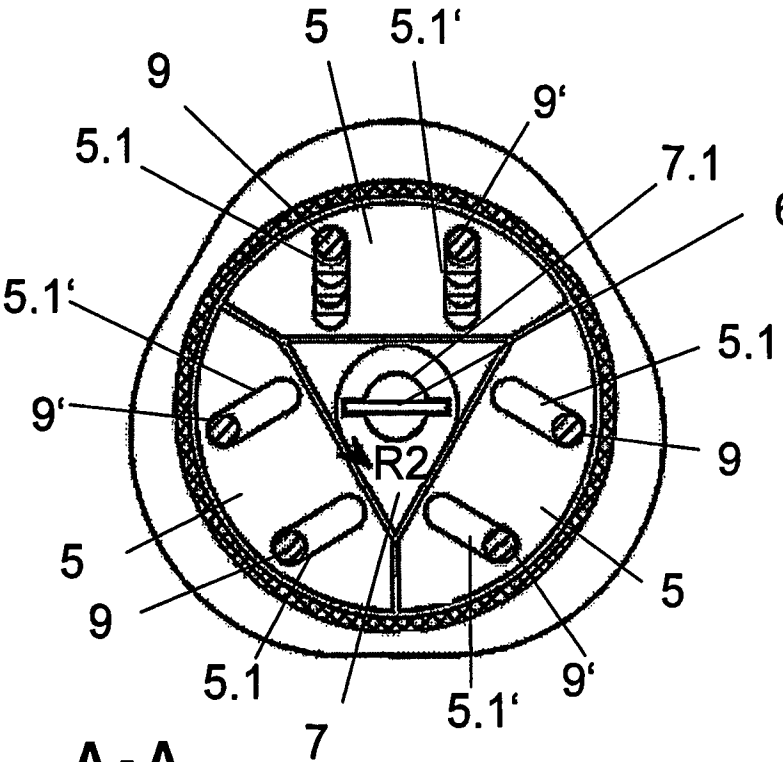

The rod-shaped massaging device 1 according to the invention depicted in side view in FIGS. 1 and 2 respectively, is made up of a cylindrical end element 2, a shell 3 made of a rubber-elastic material forming the outer surface of the end element 2 and a drive unit 4 for generating an oscillating motion of the end element 2, especially of the shell 3. The drive unit 3 is formed by a plurality of support elements 5, preferably jaw elements, against the outer bearing and support surfaces 5.2 of which the shell 3 bears.

The massaging device 1 according to the invention, further comprises a preferably disk-shaped support element 8, which is adjoined by several guide and support elements 9 extending along the longitudinal axis LA of the massaging device 1 and protruding over at least one side of the support element 8. In the present embodiment, the guide and support elements 9 are rod-shaped and are provided for receiving the preferably jaw-shaped support elements 5. The bearing and support surfaces 5.2 of the support elements 5 are provided for an oscillating deformation of the shell 3 relative to the longitudinal axis LA of the end element 2 radially outward and inward by means of radial stroke motions of the bearing and support surfaces 5.2.

These support elements 5, in the depicted embodiment, have a flat or graduated disk shape, so that for example three such support elements 5 are combined to form one disk-shaped set of support elements. The support elements 5 or the support element sets formed by the latter and oriented with their surface sides perpendicular to the longitudinal axis of the massaging device 1 are arranged consecutively in a stack along the longitudinal axis LA of the massaging device 1 to form a stack of support elements. FIGS. 3*a* and 3*b* and FIGS. 4*a* and 4*b*, based on cross sections along the section lines A-A and B-B show the inner structure of the massaging device 1 according to FIGS. 1 and 2.

In the depicted embodiment, the guide and support elements 9 arranged at a distance from each other along the longitudinal axis LA of the massaging device 1 form three guide and support element groups with two guide and support elements 9, 9' respectively. The three guide and support element groups are offset respectively by 120° around the longitudinal axis LA of the massaging device 1, namely so that the axes of the respective two guide and support elements 9 of one group have the same radial distance to the longitudinal axis LA and are at a distance from each other.

Each support element 5 features two oblong holes 5.1, 5.1', through which both guide and support elements 9, 9' of one group are guided, and the orientation of the oblong holes 5.1, 5.1' is such that the support elements 5 are approximately radially movable relative to the longitudinal axis LA. The bearing and support elements 5.2 of the support elements 5 are designed in the form of a partial cylinder surface. In one embodiment of the invention, the outer diameter of the support element set formed by three support elements 5 respectively can change along the longitudinal axis LA, namely so that the outer diameter of the sets of support element decreases on the side facing away from the support element 8. Depending on the embodiment, other constant or periodic changes in the outer diameter can be implemented.

Figures 8A, 8B:
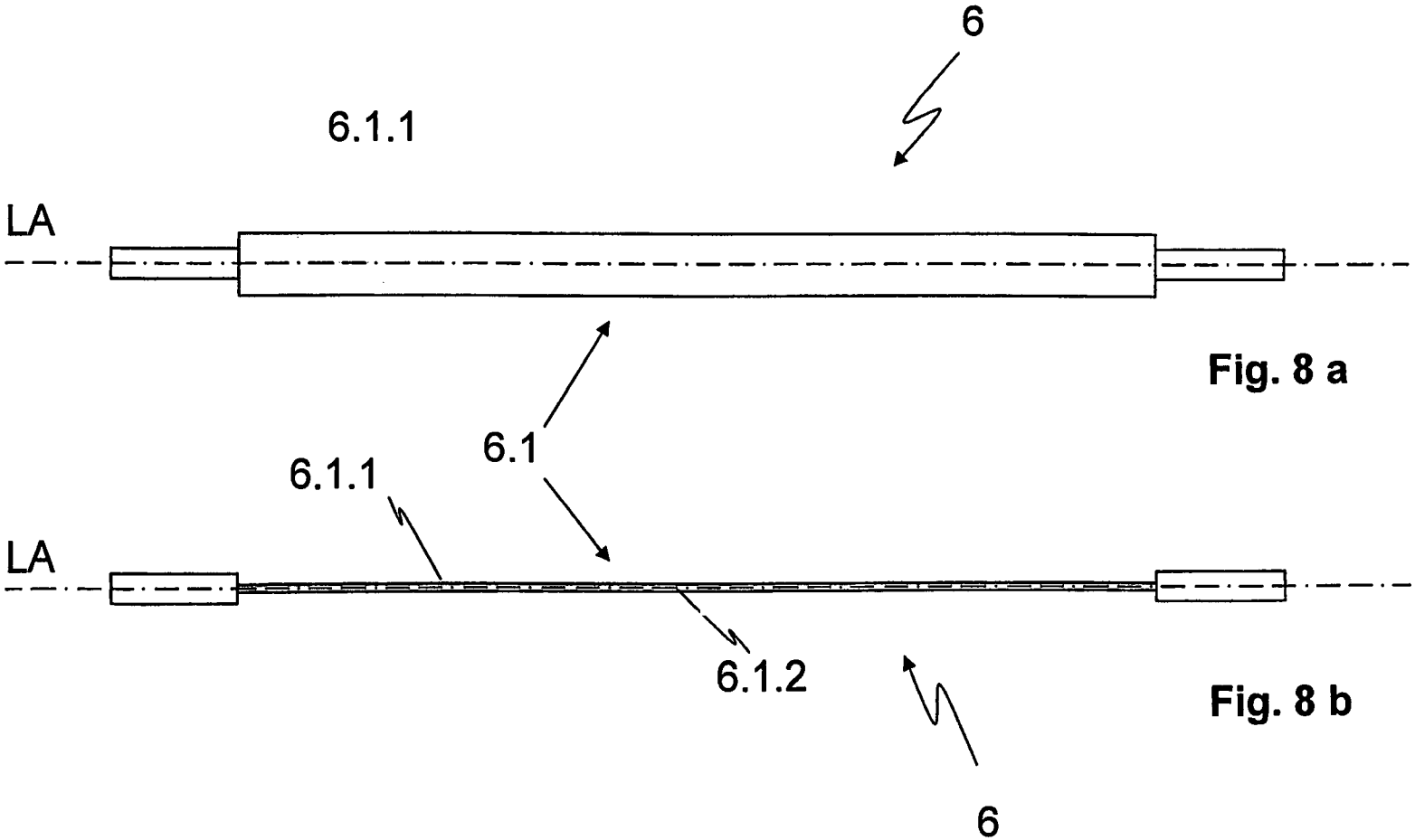
FIGS. 8*a, b* shows two side views of a shaft in a first position and a position twisted 90° on the longitudinal axis.

On the same axis with the longitudinal axis LA, a shaft 6 is rotatably mounted in the support element 8, as depicted in FIGS. 8*a, b*, whereby the shaft 6 comprises a shaft section 6.1 that is at least non-circular in form and in the depicted embodiment rectangular. The shaft 6 can be driven by a drive, not depicted in the drawings, in two drive directions or directions of rotation R1, R2. FIGS. 8*a* and 8*b* show for example a shaft 6 in two side views, the shaft according to FIG. 8*b* being twisted 90° around the shaft longitudinal axis LA as compared with the shaft 6 according to FIG. 8*a*.

At least in the area of the shaft section 6.1, a plurality of preferably level eccentric elements 7 are lined up on the shaft 6, one respective eccentric element 7 being surround by at least one group of support elements 5 and interacting with the latter. The eccentric elements 7 comprise a preferably centered inner opening 7.1, through which the shaft 6, in particular the shaft section 6.1 is guided, so that the eccentric elements 7 adjoin each other along the longitudinal axis LA to form a stack, corresponding to the support elements 5. The support elements 5 lie with their inner bearing surface 5.3 against at least one of the eccentric elements 7. Due to the shell 3 made of rubber-elastic material surrounding the support elements 5, the support elements 5 are pre-tensioned radially against the adjoining eccentric elements 7.

The massaging device 1, according to the invention, features a first and second operating mode T, W: in the first operating mode T an in-phase deformation of the shell 3 along the longitudinal axis LA is achieved by the radial stroke motions of the bearing and support surfaces 5.2 from inside to outside and vice versa generated by means of the drive unit 4, i.e. in the first operating mode T, all bearing and support surfaces 5.2 have the same distance to the longitudinal axis LA during the radial stroke motion. In the second operating mode W, on the other hand, an out-of-phase oscillating deformation of the shell 3 along the longitudinal axis LA takes place, i.e. the bearing and support surfaces 5.2 have at least partially different distances to the longitudinal axis LA during the radial stroke motion. Therefore, in the first operating mode T ("throbber") a circumferential pulsing massage motion of the shell 3 of the end element 2 is produced and in the second operating mode W ("waver") a wave-like massage motion of the shell 3 of the end element 2 advancing along the longitudinal axis is produced. The first and second operating mode T, W of the massaging device 1 according to the invention are determined by the drive direction R1, R2 of the drive or the direction of rotation R1, R2 of the shaft 6, namely the shaft 6 can be driven in a first direction of rotation R1 ("clockwise") and a second direction of rotation R2 ("counter-clockwise").

Figures 6, 7:
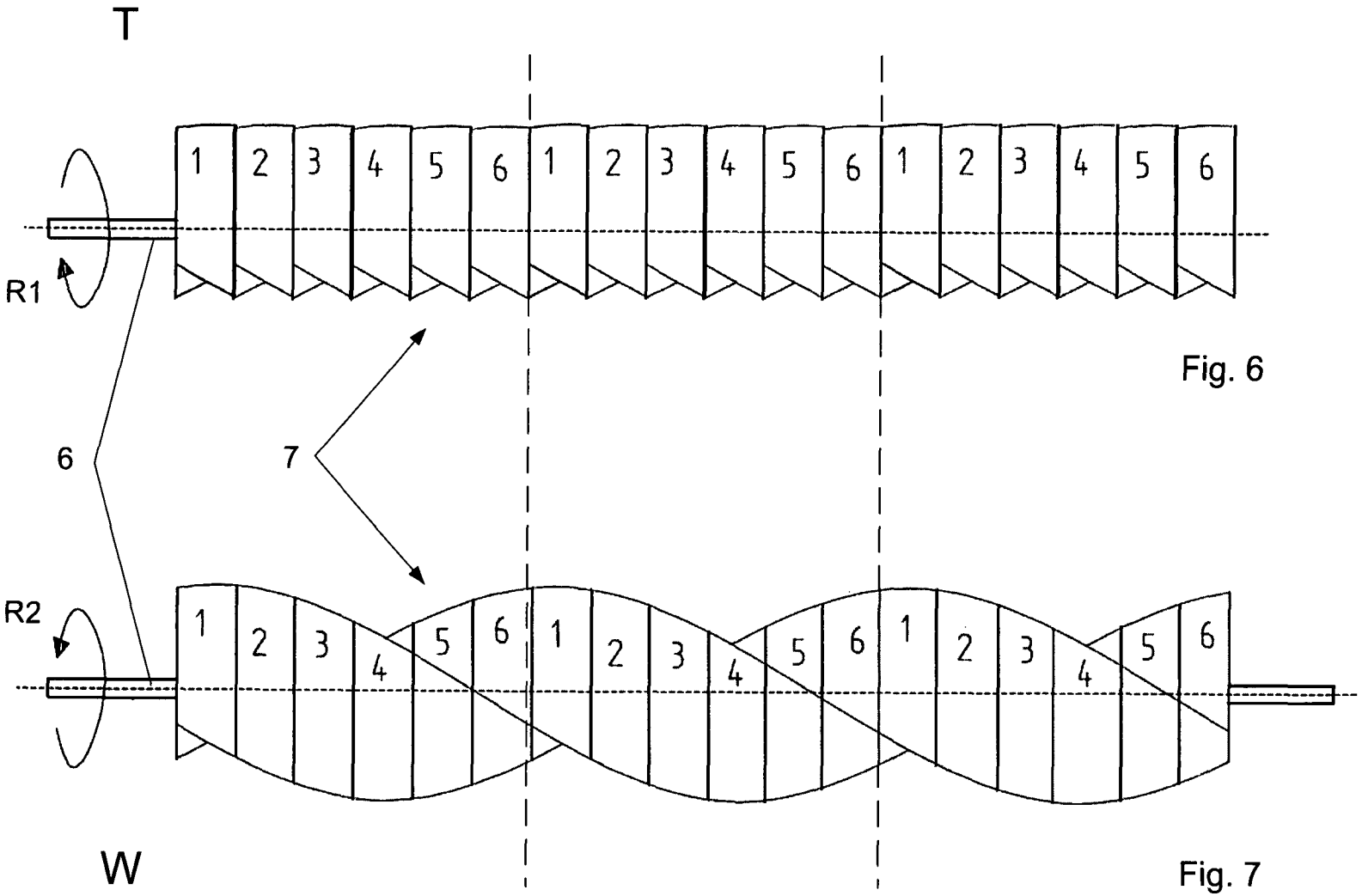
FIG. 6 shows a side view of a shaft with lined up eccentric elements in a first direction of rotation.
FIG. 7 shows a side view of a shaft with lined up eccentric elements in a second direction of rotation.

FIGS. 6 and 7 show the shaft 6 with eccentric elements 7 lined up on said shaft in respective side views, the shaft 6 being driven according to FIG. 6 in the first direction of rotation R1 ("clockwise") and according to FIG. 7 in the second direction of rotation R2 ("counter-clockwise"). The shaft 6 and/or the inner openings 7.1 of the eccentric elements 7 guided on the shaft section 6.1 are designed so that they can rotate at least partially by pre-defined angular amounts around the longitudinal axis LA. In the present embodiment, several groups of different eccentric elements 7 are depicted, each group comprising the same arrangement of different eccentric elements 7, i.e. the eccentric elements 7 recur periodically along the longitudinal axis LA. One group comprises for example six eccentric elements 7, with inner openings 7.1 that have different respective cross sectional forms.

Figure 5:
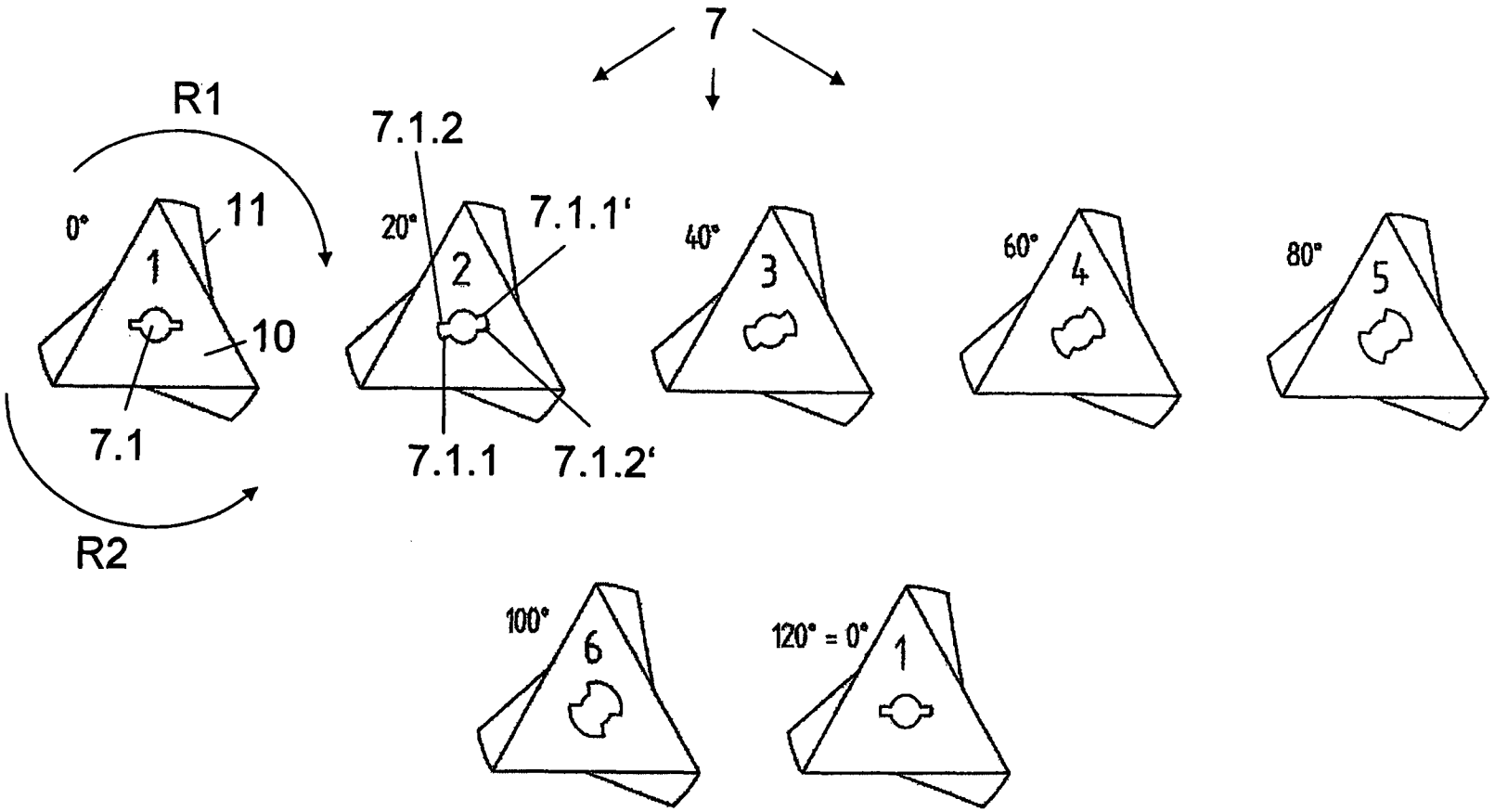
FIG. 5 shows perspective views of different eccentric elements.

FIG. 5 shows a front view of the respective six different eccentric elements 7 of one group, the seventh depicted eccentric element 7 being identical to the first eccentric element 7. The eccentric elements 7 of one group differ from each other only by the cross sectional form of the inner opening 7.1 and one of the inner openings 7.1 of a group has the same form as the cross section of the shaft section 6.1. The inner openings 7.1 respectively comprise at least two, preferably four stop surfaces 7.1.1, 7.1.2, which are formed respectively by level inner wall surface sections respectively extending radially to the longitudinal axis LA or the longitudinal axis of the inner opening 7.1.

In the present embodiment, the at least two stop faces 7.1.1, 7.1.2, 7.1.1', 7.1.2' of the first eccentric element 7 of a group extend approximately parallel to each other. The stop faces 7.1.1, 7.1.2 of the further eccentric elements 7 of a group deviate from this parallelism and enclose a pre-defined angle of for example 20°, 40°, 60°, 80° and 100° to each other, the angular increase being constant in the present embodiment. Therefore, the angle between the at least two stop faces 7.1.1, 7.1.2 along the longitudinal axis LA of the shaft 6 increases within a group, gradually by the same respective angular amount.

The eccentric elements 7 comprise a first and second face 10, 11, which has a polygonal or polygon-like cross sectional form, in the embodiment depicted here a triangular form. Further, the first and second face 10, 11 respectively form level surface sections extending parallel to each other, which preferably are offset to each other around the longitudinal axis LA of the eccentric elements 7. Both the angular amounts of the two stop surfaces 7.1.1, 7.1.2 of the individual consecutive eccentric elements 7 and the number of eccentric elements 7 in a group, the cross sectional form of the opposing faces 10, 11 and their radial twist to each other are matched to each other so that after lining up of several groups of eccentric elements 7 on the shaft 6, an outer contour that is dependent on the direction of rotation R1, R2 is formed.

If the shaft 6 is driven in the first direction of rotation R1, then the mutually adjoining faces 10, 11 of the adjacent eccentric elements 7 are approximately congruent to each other (see FIG. 6). If on the other hand the shaft 6 is driven in the second direction of rotation R2, this results in an approximately spiral outer contour (see FIG. 7). The deformation of the outer contour is therefore dependent on the direction of rotation R1, R2 of the shaft 6, which results from the twisting of the individual eccentric elements 7 in relation to each other around the shaft longitudinal axis LA caused by the different stop faces 7.1.1, 7.1.2. The at least two stop faces 7.1.1, 7.1.2, in combination with the rectangular cross section of the shaft 6 in the area of the shaft section 6.1, therefore limits this twisting, so that the respective angular amount by which one eccentric element 7 can be twisted on the shaft longitudinal axis LA increases discretely.

To achieve the spiral form, the first and second faces 10, 11 of each eccentric element 7 in the depicted embodiment are twisted in relation to each other by the same angular amount, namely by the angular amount resulting from the difference between the at least two stop faces 7.1.2 of two adjacent eccentric elements 7. This angular amount in the depicted embodiment is for example ca. 20°. This achieves constant transitions respectively between two adjacent eccentric elements 7 in the case of the second direction of rotation R2, i.e. the second face 11 of an eccentric element 7 is approximately congruent with the first face 10 of the following eccentric element 7, and the shaft section 6.1 of the shaft 6 bears against the second stop face 7.1.2, respectively. In the first direction of rotation R1, the first stop face 7.1.1 bears against the rectangular shaft section 6.1. The result is that all respective first faces 10 and all respective second faces 11 of all eccentric elements 7 are congruent to each other, which in the present embodiment produces an approximately prismatic outer contour.

The different outer contours affect the type of deformation of the shell 3. A spiral outer contour causes a phase-shifted oscillating deformation of the shell 3 along the longitudinal axis LA; i.e. the radial excursion of the support elements 5 guided by means of the guide and support elements 9 relative to the longitudinal axis LA has different amplitudes, which results in a wave-like motion. An approximately prismatic outer contour for example with a triangular cross sectional surface causes an in-phase oscillating deformation of the shell 3 along the longitudinal axis LA, i.e. the radial excursion of all support elements 5 takes place with the same amplitude. Applied to the overall massaging device 1, this means that the circumference of the shell 3 over the entire longitudinal axis LA increases or decreases radially, namely periodically depending on the drive speed or angular velocity of the shaft 6.

Figure 9B:
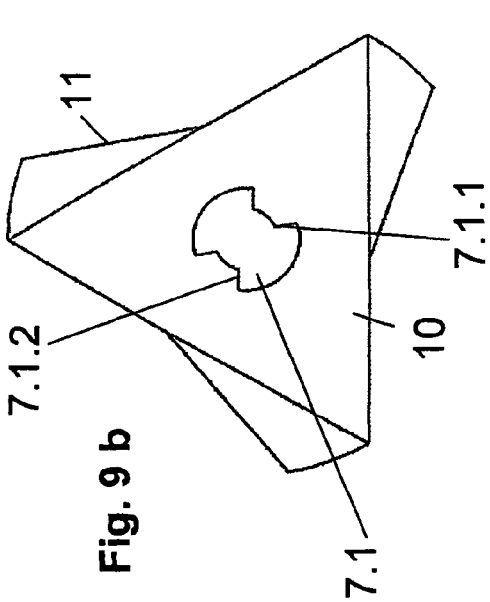
FIG. 9*a-c* shows a side view of an alternative embodiment of the eccentric elements and of the corresponding shaft.
Figure 9A:
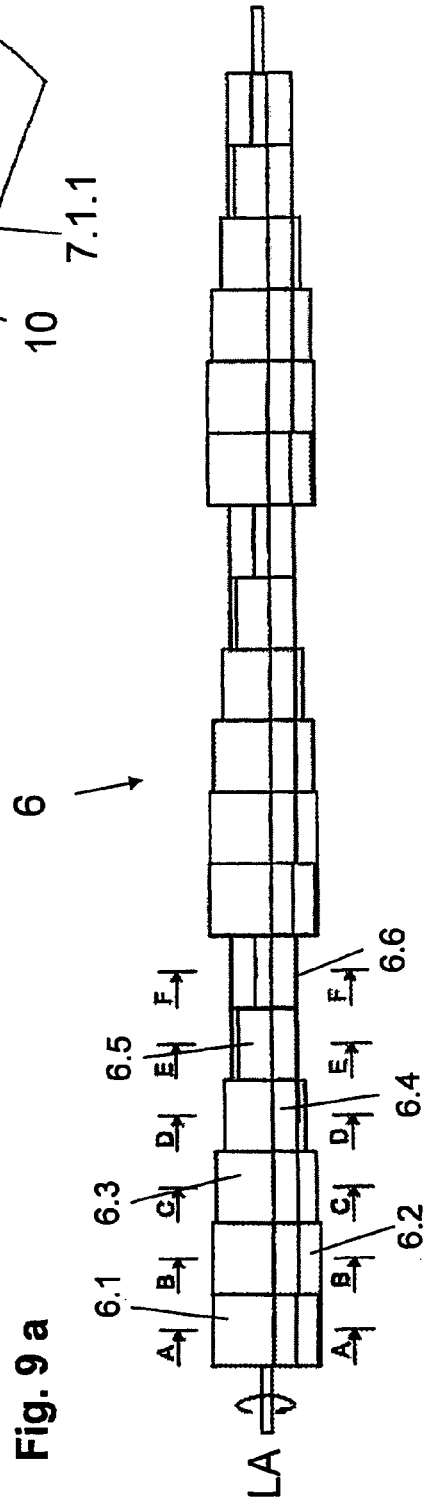
Figure 9C:
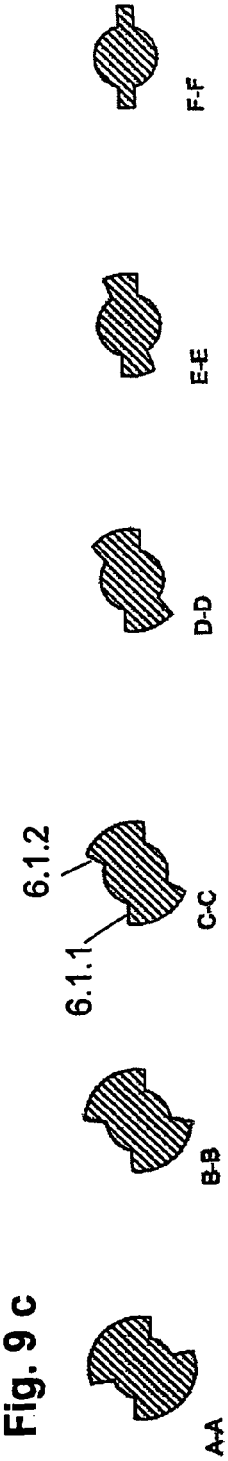
Figure 10B:
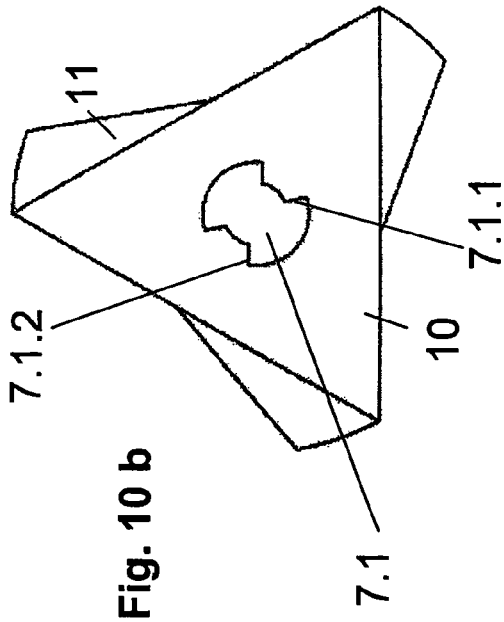
FIG. 10*a-c* shows for example a side view of a further alternative embodiment of the eccentric elements and of the corresponding shaft.
Figure 10A:
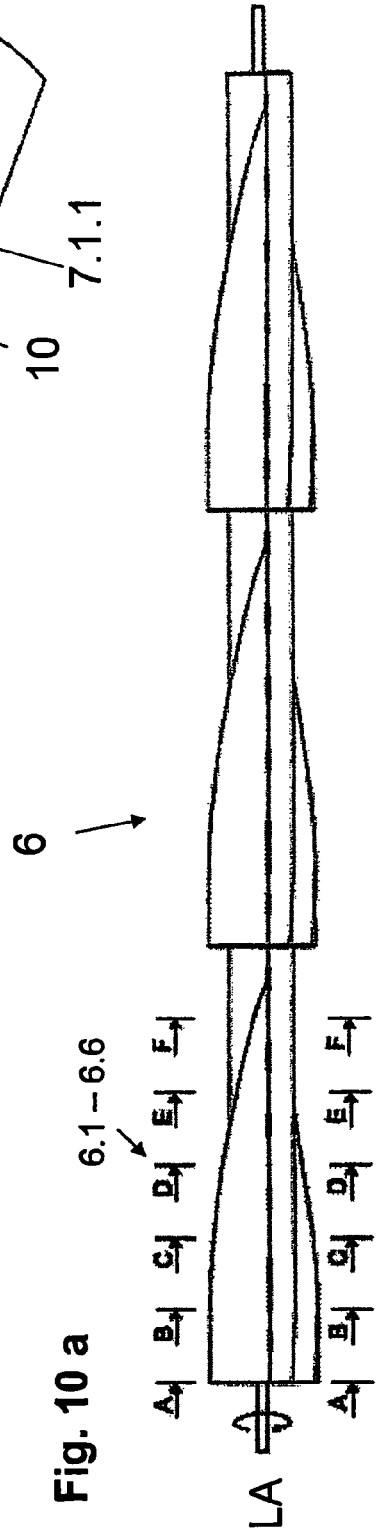
Figure 10C:
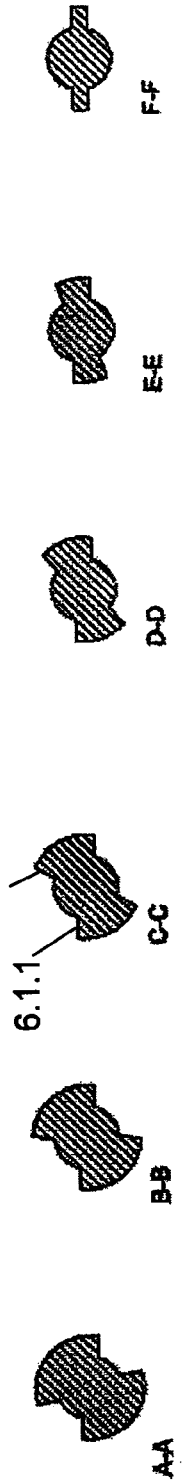

In an alternative embodiment of the drive unit 4 according to FIGS. 9*a-c* and FIGS. 10*a-c* all eccentric elements 7 have an inner opening 7.1 with the same cross sectional form, in which case preferably the at least two stop faces 7.1.1, 7.1.2 are oriented perpendicular to each other. The shaft 6—as shown in FIGS. 9*a* and 10*a*—is made up of several shaft sections 6.1 through 6.6, which have different respective cross sectional forms. The transition between the individual shaft sections 6.1 to 6.6 can be gradual (FIG. 9*a*) or continuous (FIG. 10*a*), for example. Further the shaft sections 6.1 to 6.6 form a group, which continues periodically along the longitudinal axis LA.

The cross sectional form of the shaft sections 6.1 to 6.6 corresponds essentially to the cross sectional form of the inner opening 7.1 of the eccentric elements 7, the shaft sections 6.1 to 6.6 likewise comprising at least two stop faces 6.1.1, 6.1.2, which interact with the stop faces 7.1.1, 7.1.2 of the inner opening 7.1 of the eccentric elements 7 or engage with the latter. The at least two stop faces 6.1.1, 6.1.2 of the shaft sections 6.1 to 6.6 respectively have a different angle in relation to each other, so that corresponding to the above exemplary embodiment, changing the direction of rotation R1, R2 produces the outer contours described above in the first and second operating mode T, W.

The invention was described above based on several exemplary embodiments. It goes without saying that numerous modifications and variations are possible without abandoning the underlying inventive idea upon which the invention is based.

For example, the eccentric elements 7 can comprise practically any polygonal or polygon-shaped faces 10, 11, in which case these faces 10, 11 are for example at a distance from each other, parallel and congruent. Also, the eccentric elements 7 can be very thin and the angular difference between two adjacent eccentric elements 7 can be varied.

REFERENCE LIST

1 massaging device
2 end element
3 shell
4 drive mechanism
5 support elements
5.1 oblong holes
5.2 outer surfaces
5.3 inner bearing surfaces
6 shaft
6.1-6.6 shaft sections
6.1.1, 6.1.2 stop faces
7 eccentric elements
7.1 inner opening
7.1.1, 7.1.2 stop faces
7.1.1', 7.1.2' stop faces
8 support element
9 guide and support elements
10 first face
11 second face
LA longitudinal axis
T first operating mode
W second operating mode
R1 first direction of rotation—clockwise
R2 second direction of rotation—counterclockwise

What is claimed is:

1. A massaging device in the shape of a rod comprising an essentially cylindrical end element, a shell forming an outer surface of the end element made of a rubber-elastic material and a drive unit for generating a motion on the end element, the drive unit forming a plurality of bearing and support surfaces, against which the shell bears and the plurality of bearing and support surfaces for an oscillating deformation of the shell relative to a longitudinal axis (LA) of the end element radially outward and inward by means of radial stroke motions of the plurality of bearing and support surfaces, wherein the massaging device comprises first and second operating modes (T, W), in the first operating mode (T) the oscillating deformation along the longitudinal axis (LA) being in phase and in the second operating mode (W) the oscillating deformation being out of phase and wherein the plurality of bearing and support surfaces are formed by a plurality of support elements and for an oscillating motion of the support elements, a shaft is driven by the drive unit in two directions of rotation (R1, R2), and wherein the first operating mode and the second operating mode (T,W) is determined by the drive direction (R1, R2) of the shaft as driven by the drive unit and wherein several eccentric elements on the shaft interact with the plurality of support elements.

2. The massaging device according to claim 1, wherein several support elements arranged in a common plane perpendicular to the longitudinal axis (LA) of the end element respectively form a group of the support elements and a plurality of the groups of the support elements are provided consecutively along the longitudinal axis (LA) of the end element.

3. The massaging device according to claim 1, further comprising means for driving the shaft in two directions of rotation (R1, R2).

4. The massaging device according to claim 3, wherein the two direction of rotation (R1, R2) of the shaft determines the operating mode (T, W) of the massaging device.

5. The massaging device according to claim 1, whereby for guiding on the shaft, one eccentric element respectively comprises an inner opening.

6. The massaging device according to claim 5, wherein the inner openings of the eccentric elements have different cross sectional forms.

7. The massaging device according to claim 5, wherein the inner openings of the eccentric elements form at least two stop faces, which interact with at least one stop face of the shaft depending on the direction of rotation (R1, R2) of the shaft.

8. The massaging device according to claim 1, wherein the at least one shaft comprises at least one shaft section with a polygonal or polygon-shaped cross section, or a rectangular cross section.

9. The massaging device according to claim 8, wherein the at least one shaft section forms at least two stop faces.

10. The massaging device according to claim 8, whereby periodically recurring groups of several eccentric elements are lined up at least along the shaft section of the shaft.

11. The massaging device according to claim 1, wherein at least one eccentric element of a group of eccentric elements is guided on a shaft section of the at least one shaft in a torsion-proof manner on the shaft longitudinal axis (LA) and additional eccentric elements of the group of eccentric elements are guided rotatably on the shaft longitudinal axis (LA) by respectively different angular amounts limited by interacting stop faces.

12. The massaging device according to claim 11, wherein the interacting stop faces define angle ranges and the angle ranges of all eccentric elements of a group of eccentric elements at least partially overlap.

13. The massaging device according to claim 1, wherein an eccentric element of the several eccentric elements comprises two opposing faces with a polygonal or polygon-shaped outer cross sectional form, whereby the two opposing faces extend parallel to one another and are twisted in relation to each other.

14. The massaging device according to claim 1, wherein the eccentric elements have a same outer contour, or an at least partially twisted outer contour.

15. The massaging device according to claim 14, wherein in the first operating mode (T) the outer contour formed by the several eccentric elements is approximately prismatic.

16. The massaging device according to claim 14, wherein in the second operating mode (W) the outer contour formed by the several eccentric elements is approximately spiral-shaped.

17. The massaging device according to claim 16, wherein the eccentric elements of the several eccentric elements comprises two opposing faces and in the second operating mode (W) two opposing faces of the eccentric elements are lined up approximately congruently on the shaft along the longitudinal axis (LA).

* * * * *